US008925235B2

(12) United States Patent
Buie, II

(10) Patent No.: US 8,925,235 B2
(45) Date of Patent: Jan. 6, 2015

(54) FIREARM CLEANING KITS AND HANDLES THEREFORE

(71) Applicant: DAC Technologies Group International, Inc., Little Rock, AR (US)

(72) Inventor: James H Buie, II, Little Rock, AR (US)

(73) Assignee: DAC Technologies Group International, Inc., Miami, FL (US)

( * ) Notice: Subject to any disclaimer, the term of this patent is extended or adjusted under 35 U.S.C. 154(b) by 50 days.

(21) Appl. No.: 13/869,315

(22) Filed: Apr. 24, 2013

(65) Prior Publication Data

US 2013/0283658 A1 Oct. 31, 2013

Related U.S. Application Data

(60) Provisional application No. 61/638,120, filed on Apr. 25, 2012.

(51) Int. Cl.
*F41A 29/02* (2006.01)

(52) U.S. Cl.
CPC ..... *F41A 29/02* (2013.01)
USPC ..... 42/95; 42/90

(58) Field of Classification Search
CPC ..... F41A 29/00; F41A 29/02; B08B 9/0436; B08B 9/02; B08B 9/021; B08B 9/023; B08B 9/027; A46B 2200/3013
USPC ..... 42/95, 90, 106, 85
See application file for complete search history.

(56) References Cited

U.S. PATENT DOCUMENTS

| | | | | |
|---|---|---|---|---|
| 816,959 | A | 4/1906 | Briganti | |
| 821,198 | A * | 5/1906 | Stocker | 15/104.165 |
| 1,237,056 | A * | 8/1917 | Kitchen | 15/104.16 |
| 1,348,145 | A * | 8/1920 | Arden | 15/104.165 |
| 1,495,008 | A | 5/1924 | Feagin | |
| 1,552,994 | A | 9/1925 | Lindeman | |
| 1,665,988 | A * | 4/1928 | Smith | 15/104.165 |
| 1,769,967 | A | 7/1930 | Saurman | |
| 2,058,756 | A | 10/1936 | Earl | |
| 2,744,275 | A | 5/1956 | Geltner | |
| 2,744,635 | A | 5/1956 | Hiss | |
| D192,047 | S | 1/1962 | Farmer | |
| 3,064,294 | A | 11/1962 | Stocking | |
| 3,076,904 | A | 2/1963 | Arthur | |
| D223,874 | S | 6/1972 | Ellis | |

(Continued)

FOREIGN PATENT DOCUMENTS

GB 2185209 7/1987

*Primary Examiner* — Bret Hayes
*Assistant Examiner* — Joshua Freeman
(74) *Attorney, Agent, or Firm* — Stephen D. Carver

(57) ABSTRACT

Firearm cleaning kits and handles therefore optimized for pulling cleaning elements through firearm barrels away from the breach or action. Dislodged residue is displaced and removed out the muzzle. Each cleaning kit comprises one or more handles designed for axial displacements, twisting or torsional displacements, and lateral movements for pulling. Each handle comprises an elongated solid or hollow body with a bore and a slotted handle intersecting the bore. A pull cord anchor is passed through the bore, and after sliding the cable, the anchor is restrained by the follower slot either interiorly or exteriorly of the handle. A tapered front end of the handle may include a threaded socket for connection to a cleaning rod or a driving surface. The opposite handle end may include a hex drive for a variety of cleaning tools.

40 Claims, 14 Drawing Sheets

(56) References Cited

U.S. PATENT DOCUMENTS

| | | | | | |
|---|---|---|---|---|---|
| 3,813,802 | A | | 6/1974 | Di Prospero | |
| 3,894,766 | A | | 7/1975 | Woodward | |
| 4,239,318 | A | | 12/1980 | Schwartz | |
| D268,987 | S | | 5/1983 | Smith | |
| 4,399,627 | A | | 8/1983 | Malesky | |
| 4,499,625 | A | | 2/1985 | Bottomley | |
| 4,521,356 | A | | 6/1985 | Keller | |
| 4,674,218 | A | * | 6/1987 | Bottomley | 42/95 |
| 4,716,673 | A | | 1/1988 | Williams | |
| 4,807,381 | A | | 2/1989 | Southard | |
| 4,843,747 | A | * | 7/1989 | Echeberria | 42/90 |
| 4,873,777 | A | | 10/1989 | Southard | |
| 4,899,415 | A | | 2/1990 | Wheeler | |
| 4,901,464 | A | | 2/1990 | Banoun | |
| 4,901,465 | A | | 2/1990 | Hsu | |
| 4,930,240 | A | | 6/1990 | Bice | |
| D310,302 | S | | 9/1990 | Southard | |
| D313,886 | S | | 1/1991 | Southard | |
| 5,011,174 | A | | 4/1991 | Ross-Clunis | |
| D318,156 | S | | 7/1991 | Banovich | |
| 5,052,555 | A | | 10/1991 | Harmon | |
| 5,075,998 | A | | 12/1991 | Selleck | |
| 5,202,523 | A | | 4/1993 | Grossman | |
| 5,220,933 | A | | 6/1993 | Albers | |
| 5,233,124 | A | | 8/1993 | Peterson | |
| D339,470 | S | | 9/1993 | Marks | |
| 5,317,827 | A | | 6/1994 | Jaremco | |
| 5,337,505 | A | | 8/1994 | Brown | |
| 5,379,542 | A | | 1/1995 | Guzman | |
| D357,584 | S | | 4/1995 | Swingler | |
| 5,427,239 | A | | 6/1995 | Hunt | |
| D364,714 | S | | 11/1995 | Jeffery | |
| D371,413 | S | | 7/1996 | Crausby | |
| D373,297 | S | | 9/1996 | Hill | |
| D376,474 | S | | 12/1996 | Marks | |
| 5,588,242 | A | | 12/1996 | Hughes | |
| 5,645,091 | A | | 7/1997 | Hoeft | |
| D381,897 | S | | 8/1997 | Matthiesen | |
| 5,743,737 | A | * | 4/1998 | Hawn et al. | 433/141 |
| 5,755,055 | A | | 5/1998 | Thompson | |
| 5,775,020 | A | | 7/1998 | Baird | |
| 5,775,021 | A | | 7/1998 | Weiss | |
| D401,658 | S | | 11/1998 | Bullock | |
| D407,212 | S | | 3/1999 | Molaro | |
| D415,729 | S | | 10/1999 | Wells | |
| 5,972,125 | A | | 10/1999 | Hedge | |
| 6,126,005 | A | | 10/2000 | Long, Jr. | |
| 6,209,723 | B1 | | 4/2001 | Fields | |
| 6,244,899 | B1 | | 6/2001 | Bogursky | |
| 6,269,579 | B1 | | 8/2001 | Warner | |
| 6,293,743 | B1 | | 9/2001 | Ernst | |
| D449,506 | S | | 10/2001 | Haung | |
| 6,378,236 | B1 | | 4/2002 | Solberg et al. | |
| D457,697 | S | | 5/2002 | Savage | |
| 6,389,978 | B1 | | 5/2002 | Hooper et al. | |
| D480,207 | S | | 10/2003 | Marks | |
| D480,522 | S | | 10/2003 | Sasaki | |
| 6,640,480 | B2 | | 11/2003 | Williams | |
| 6,701,657 | B1 | | 3/2004 | Hudspeth | |
| D499,552 | S | | 12/2004 | Nissanoff | |
| D500,952 | S | | 1/2005 | Moore | |
| 7,020,994 | B2 | | 4/2006 | Buie, II | |
| D535,476 | S | | 1/2007 | Pennington | |
| 7,165,673 | B2 | | 1/2007 | Marks | |
| 7,356,961 | B2 | | 4/2008 | Williams | |
| 7,367,151 | B1 | | 5/2008 | Black | |
| 7,451,707 | B1 | | 11/2008 | Hadden | |
| D602,663 | S | | 10/2009 | Pennington | |
| 7,628,164 | B2 | | 12/2009 | Joen-an Ma | |
| D619,728 | S | | 7/2010 | Bare | |
| 7,841,472 | B1 | | 11/2010 | Williams | |
| 8,146,284 | B2 | | 4/2012 | Smith | |
| 8,186,092 | B2 | * | 5/2012 | Williams | 42/95 |
| D672,423 | S | * | 12/2012 | Buie, II | D22/108 |
| D672,424 | S | * | 12/2012 | Buie, II | D22/108 |
| D677,356 | S | * | 3/2013 | Buie, II | D22/108 |
| 8,448,370 | B2 | * | 5/2013 | Williams | 42/95 |
| D683,810 | S | * | 6/2013 | Buie, II | D22/108 |
| D696,741 | S | * | 12/2013 | Buie, II | D22/108 |
| 8,607,494 | B2 | * | 12/2013 | Shipman et al. | 42/95 |
| 8,707,607 | B2 | * | 4/2014 | Williams et al. | 42/90 |
| 2003/0019180 | A1 | | 1/2003 | Warren | |
| 2003/0136044 | A1 | | 7/2003 | Williams | |
| 2004/0111948 | A1 | * | 6/2004 | Schnell | 42/95 |
| 2006/0010753 | A1 | | 1/2006 | Buie, II | |
| 2006/0277811 | A1 | * | 12/2006 | Peterson | 42/95 |
| 2007/0266610 | A1 | | 11/2007 | Coffield | |
| 2008/0295818 | A1 | | 12/2008 | Styles | |
| 2009/0145785 | A1 | | 6/2009 | Garrett | |
| 2009/0193703 | A1 | | 8/2009 | Riley | |
| 2009/0199360 | A1 | | 8/2009 | Madanat | |
| 2010/0175296 | A1 | | 7/2010 | Williams | |
| 2011/0047853 | A1 | | 3/2011 | Williams | |
| 2011/0209379 | A1 | | 9/2011 | Williams | |
| 2012/0073616 | A1 | | 3/2012 | Kuelbs | |
| 2012/0186128 | A1 | * | 7/2012 | Williams et al. | 42/95 |
| 2013/0091753 | A1 | * | 4/2013 | Rogers et al. | 42/95 |
| 2013/0125925 | A1 | * | 5/2013 | Markle | 134/8 |

* cited by examiner

FIG. *1*

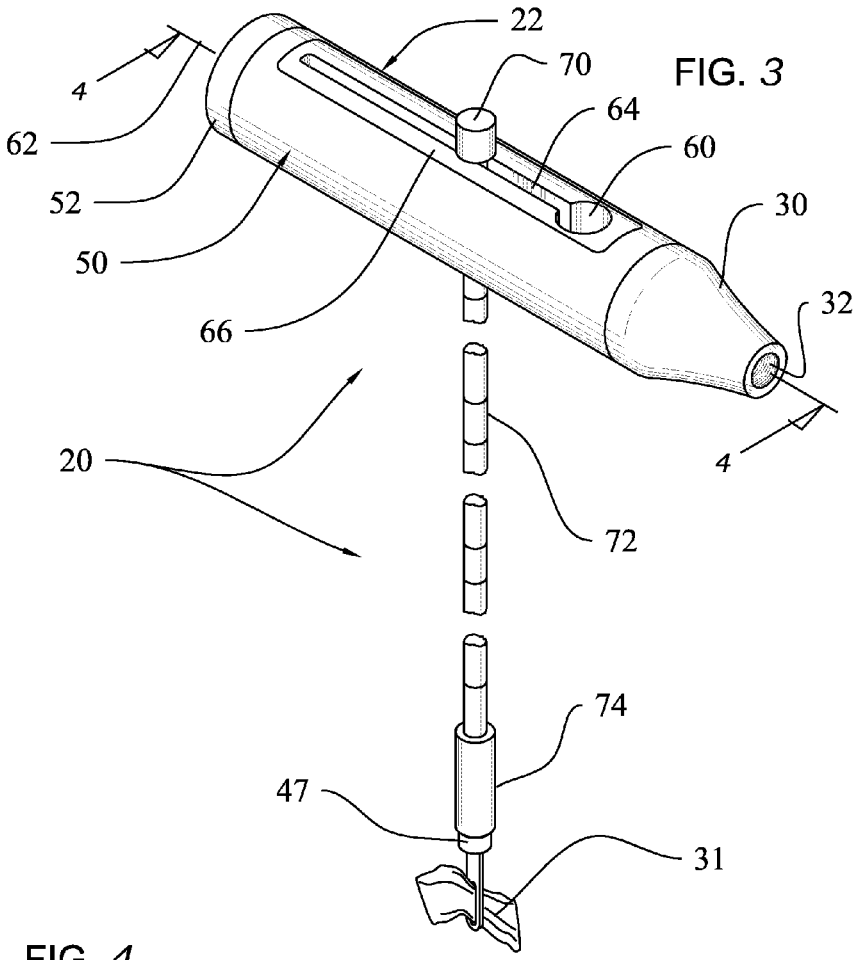
FIG. 3
FIG. 4
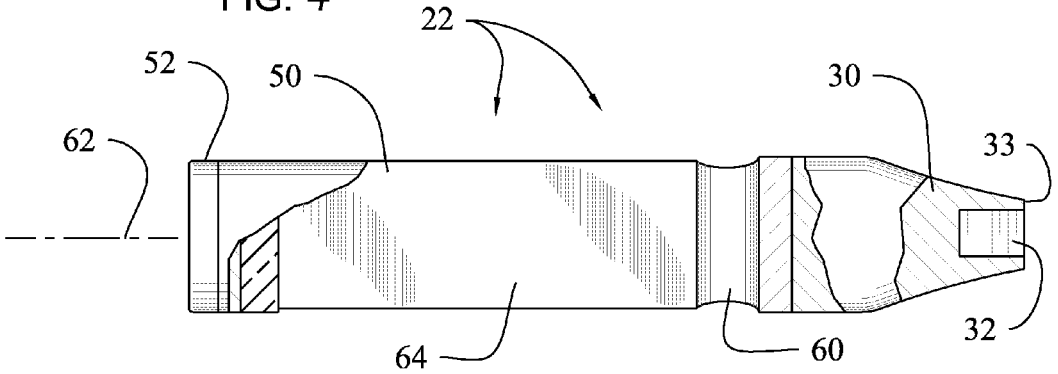

FIG. 5
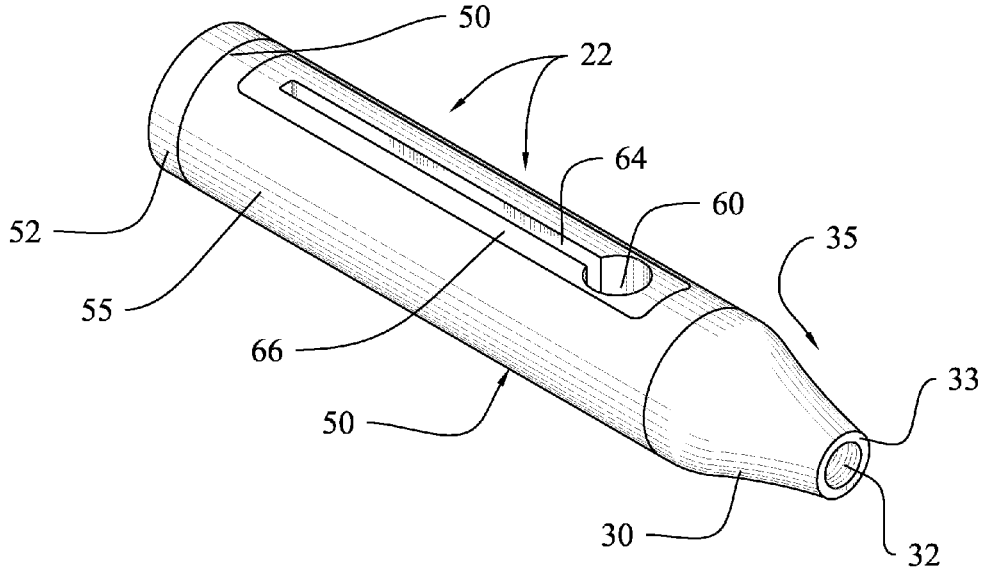
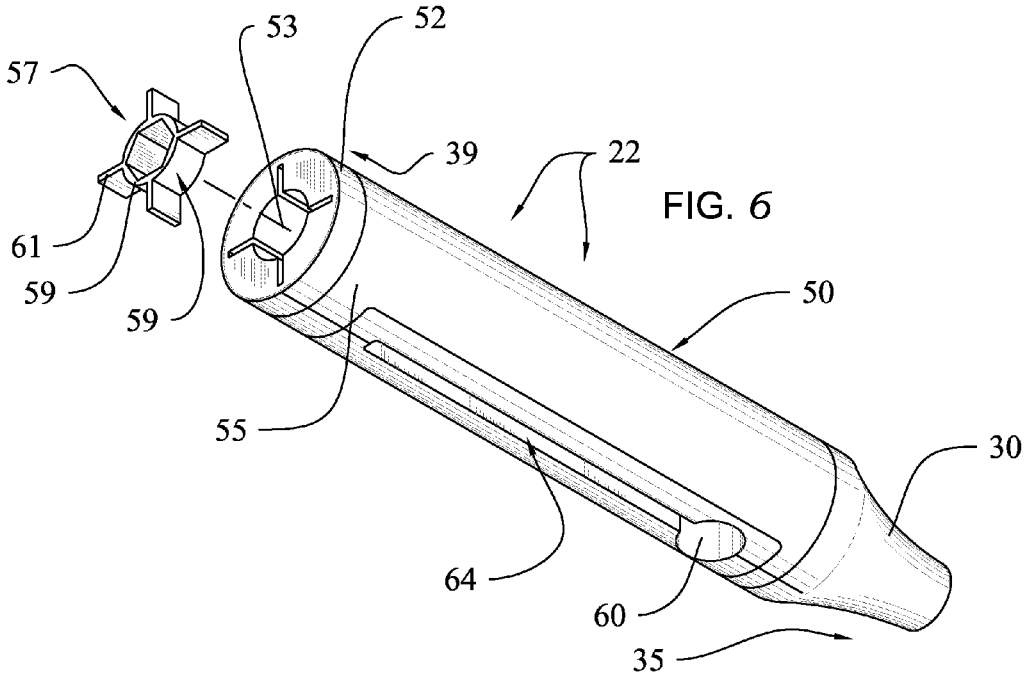
FIG. 6

FIG. *11*
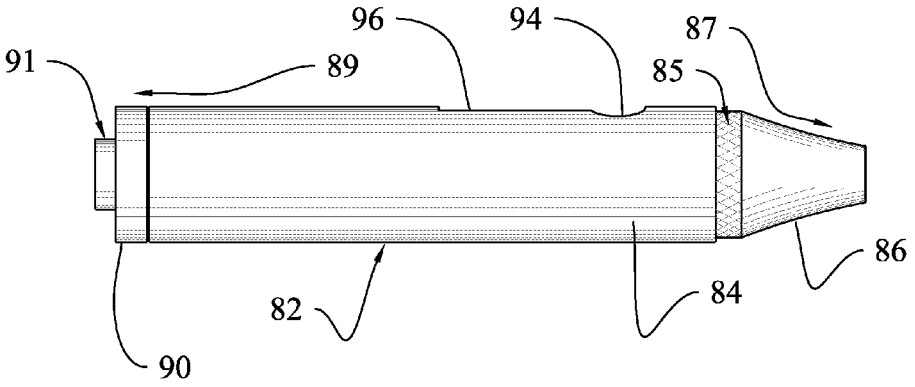
FIG. *12*
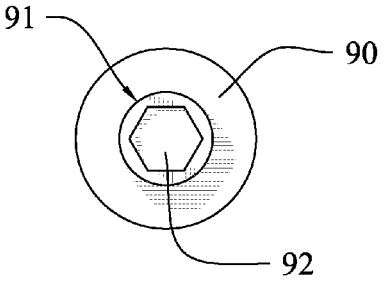
FIG. *13*
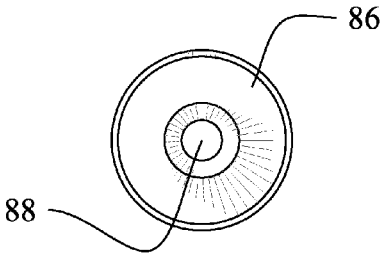

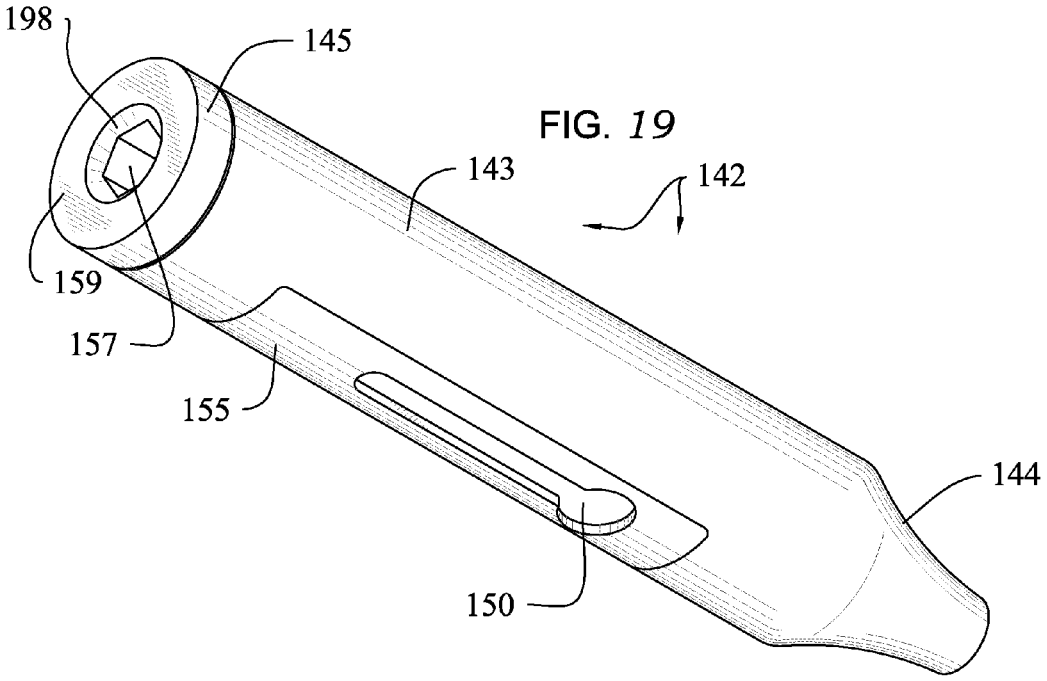
FIG. 19
FIG. 20
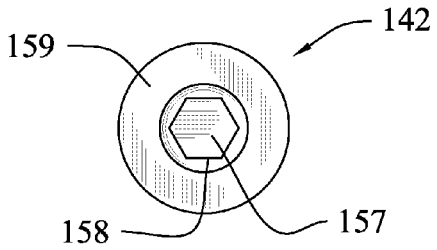
FIG. 21
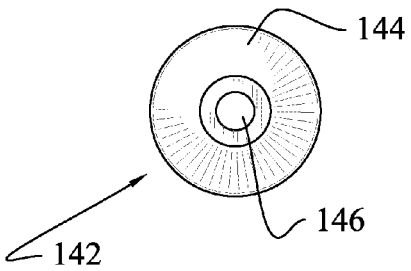

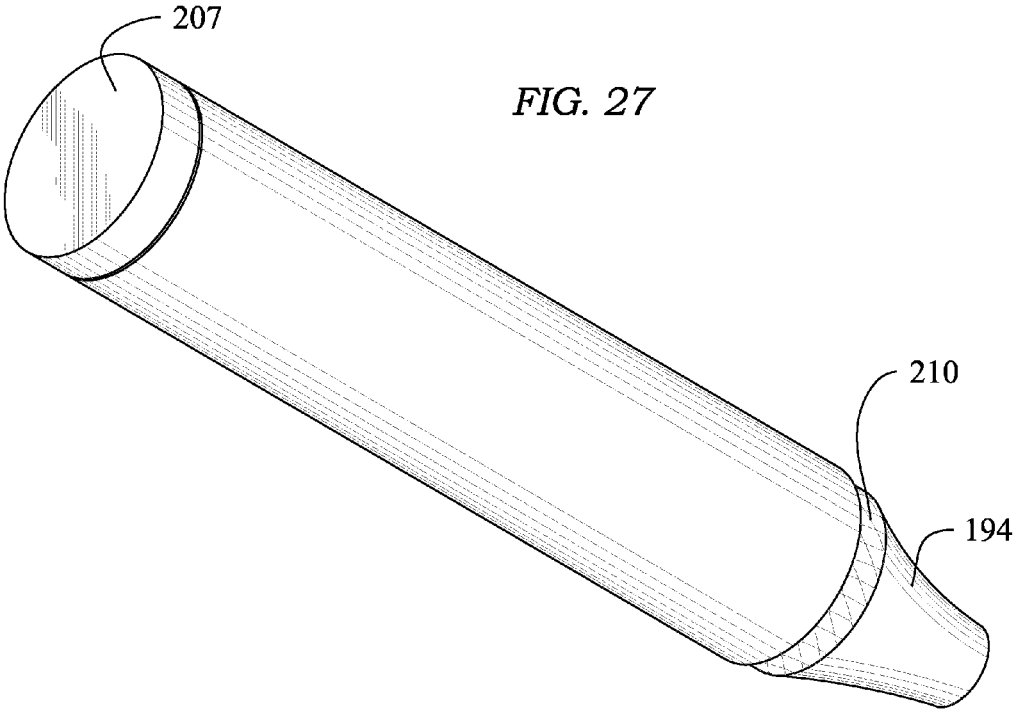
FIG. 27
FIG. 28
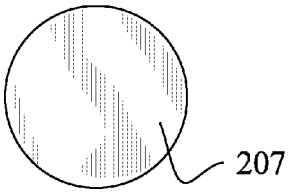
FIG. 29
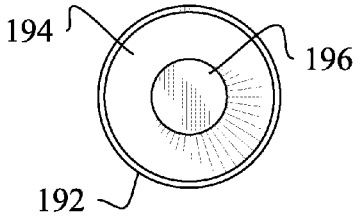

FIREARM CLEANING KITS AND HANDLES THEREFORE

CROSS REFERENCE TO RELATED APPLICATION

This utility patent application is based upon a prior U.S. Provisional Patent Application, Ser. No. 61/638,120, filed Apr. 25, 2012, by inventor James Buie, entitled "Gun Cleaning Kit," and priority based on said case and its filing date is claimed.

BACKGROUND OF THE INVENTION

I. Field of the Invention

This invention relates generally to firearm cleaning kits. More particularly, this invention relates to firearm cleaning apparatus adapted and configured to primarily use a pulling force through the barrel and breach of guns being cleaned, rather than primarily a pushing force, whereby the cleaning elements and removed debris and detritus are drawn outwardly from the gun barrel away from the breech.

II. Description of the Prior Art

It has long been recognized by those skilled in the art that periodic firearm cleaning and maintenance is vital. As firearms are used, various substances such as gunpowder residue, copper, and lead accumulate within the gun, particularly on the barrel interior. Shooting accuracy is encouraged by regular, proper cleaning of the gun barrel. Periodic cleaning insures reliability of the action, which is critical with semi-automatic firearms employing gas blowback for reloading. Adequate cleaning also preserves the aesthetic appearance of the firearm, and deterioration from rust and corrosion is also prevented. Thus frequent and proper firearm cleaning is well recognized in the art as desirable.

A typical firearm cleaning kit usually has an elongated cleaning rod, one or more brushes that are rammed through the barrel, one or more pre-cut patches, various jag attachments that drag the patches through the barrel, and a supply of a cleaning solvent that is spread over metal surfaces by the cloth patches. For long guns, the elongate, substantially solid cleaning rod is typically assembled from a plurality of separate pieces that may be threadably coupled together to form a desired length. For hand guns, only a single length of rod may be necessary. Treated patches, jags, or brushes usually secured to an end of the cleaning rod are forced into the barrel through the muzzle, and thereafter drawn in and out of the bore to vigorously spread solvent upon the exposed, internal rifling. Cleaning solvents, applied through the various patches, loosen residue, help remove deposits, encourage lubrication, and speed up cleaning.

Previously I have proposed a universal gun cleaning kit that is the subject of U.S. Pat. No. 7,020,994, issued Apr. 4, 2006, and entitled "Gun Cleaning Kit," which is owned by the same assignee as in this case. In that invention, a number of elongate rods can be employed, alone or in combination, for displacing a cleaning element through the barrel of a firearm. Selected patches, jags or cleaning elements are either rammed or pulled through the barrel with rigid rods.

Particularly with semi-automatic and full automatic long guns, it is advantageous during cleaning to move dislodged debris and dirt away from the action and out of the muzzle, rather than towards the action and the magazine feed point. Often it is difficulty and cumbersome to draw implements through the barrel being cleaned with rigid rods. The handles and actuators typically used in prior art cleaning devices can make it cumbersome and uncomfortable to pull the cleaning jags and patches through a barrel, for example.

In many gun cleaning situations it is more desirable to draw cleaning implements through the barrel by pulling rather than by pushing. Cleaning elements can be drawn through the bore with a flexible cord or cable. For example, with semi-automatic long guns, a more effective cleaning can be achieved by feeding cleaning jags, patches and the like through the breach and then pulling them towards the muzzle with a flexible cord. Dirt and debris is thus moved away from the action. Like solid ram rids, a flexible cleaning cord can enter the muzzle and travel through the barrel towards the action. However, the flexibility of non rigid pull cords, for example, eases the task of connecting to cleaning elements proximate the action and breach.

SUMMARY OF THE INVENTION

This invention provides various gun cleaning kits that are optimized for pulling cleaning elements through firearm barrels. It is preferred for firearm cleanliness to pull the cleaning parts away from the breach or action, so that dislodged residue, grime or dirt avoids the action or magazine junction region, but instead moves out the muzzle. All embodiments of the cleaning kits described herein comprise one or more handles designed for quick-connecting to either a draw cord comprising a flexible cleaning cable, or to conventional rigid, elongated metal rod elements. The cords or rod components are connected to cleaning jags with patches, or brushes that are then drawn through the barrel outwardly through the muzzle.

With each embodiment it is preferred that the handle be adapted for cleaning movements in a variety of directions. Each handle aids in cleaning when rotated about its longitudinal axis for driving nuts or screws and the like. Each can push or axially drive tools or cleaning rods in a direction coincident or parallel with its longitudinal axis. Finally, each handle is adapted to be moved in a direction perpendicular to its longitudinal axis for pulling cleaning tools through the barrel of firearms. Each handle includes a bore and a slotted handle for connecting to a pull cord or cable. The cable is connected to an anchor. In some handle embodiments the handle interiorly captivates the anchor over the follower slot, and in some embodiments the handle exteriorly captivates the anchor.

Thus a basic object of my invention is to provide a gun cleaning kit for use with a variety of firearms that applies a drawing force leading away from the breach during cleaning.

A related object is to provide a gun cleaning kit with at least one handle for conveniently drawing a cleaning element through a firearm barrel.

Another broad object is to provide a flexible draw system for firearm cleaning.

A related object is to provide a gun cleaning kit of the character described that draws cleaning elements through the firearm barrel with at least one dexterous and unique, quick-connect pull handle.

Another object of my invention is to provide a cleaning kit handle of the character described that can be used as a compound tool for cleaning firearms.

Yet another important object is to provide a gun cleaning kit whose use is not limited to traditional, elongated metal rams or rods.

Another object is to provide a gun cleaning kit with handles adapted to be moved in a direction perpendicular to the handle longitudinal axis, for pulling cleaning tools or the like.

A related object is to provide a plurality of handles for gun cleaning kits, wherein the handles are adapted to be moved in a direction perpendicular to their longitudinal axis, for pulling cleaning tools or the like.

A basic object is to provide a gun cleaning kit with at least one unique handle that can be used to draw or pull gun cleaning elements, or which can be used with conventional brass cleaning rods and the like.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 3 is an enlarged, fragmentary, isometric view of a preferred handle interconnected with a pulling cable, with portions thereof shown in dashed lines;

FIG. 4 is an enlarged, partially fragmentary, longitudinal sectional view taken generally along line 4-4 in FIG. 3;

FIG. 5 is an enlarged, frontal isometric view of the preferred handle;

FIG. 6 is a partially exploded, rear bottom isometric view of the preferred handle;

FIG. 11 is a side elevational view of a first alternative handle embodiment;

FIG. 12 is a rear plan view of the first alternative handle embodiment;

FIG. 13 is a front plan view of the first alternative handle embodiment;

FIG. 19 is a bottom isometric view of the handle embodiment of FIG. 18;

FIG. 20 is a rear plan view of the handle of FIGS. 18 and 19;

FIG. 21 is a front plan view of the handle of FIGS. 18-20;

FIG. 27 is a rear isometric view of the handle embodiment of FIG. 26;

FIG. 28 is a rear plan view of the handle of FIGS. 26 and 27; and,

FIG. 29 is a front plan view of the handle of FIGS. 26-28.

DETAILED DESCRIPTION

Figure 1:
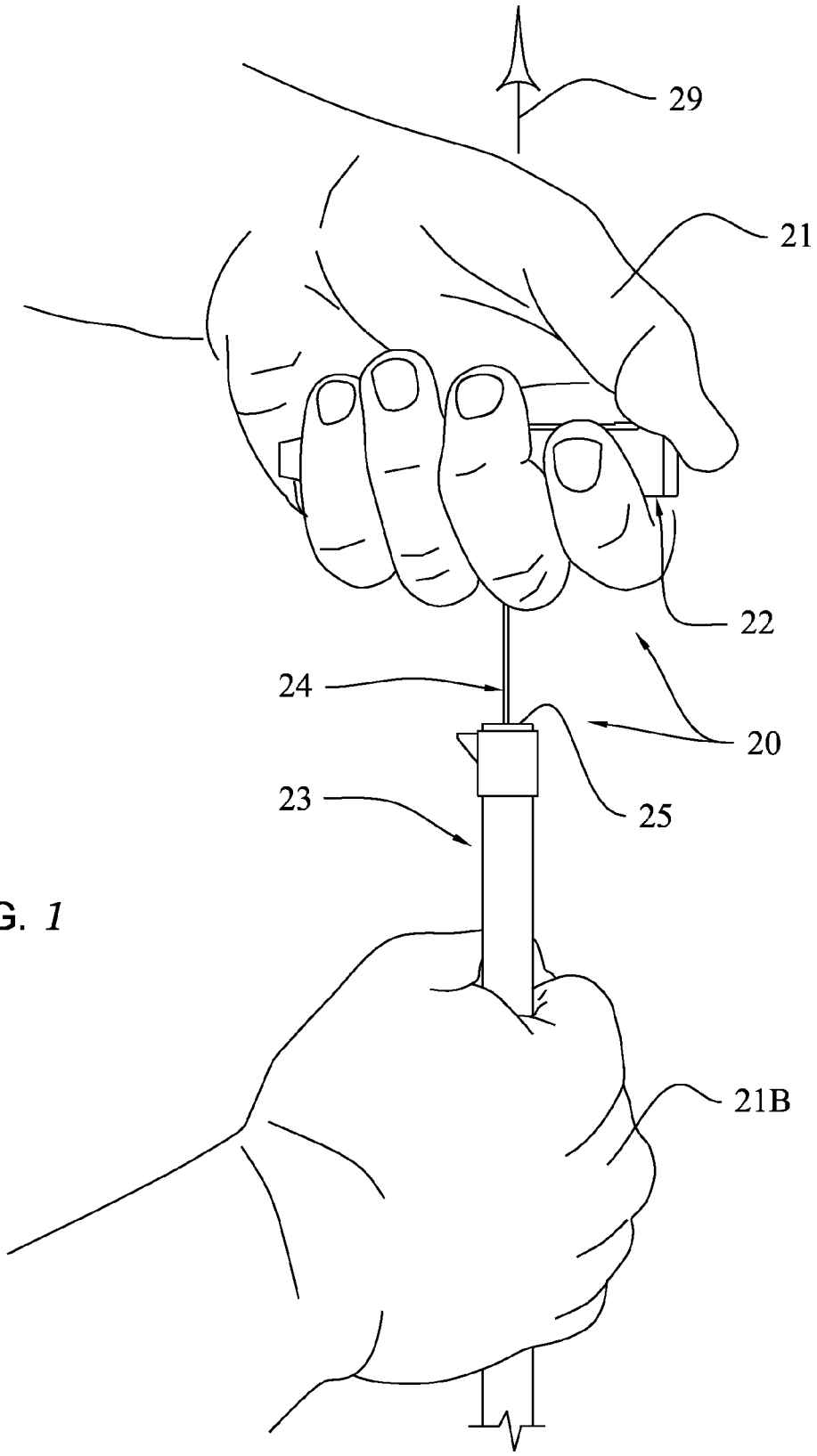
FIG. 1 is a fragmentary, diagrammatic view of a preferred embodiment of my new firearm cleaning kit, with a users hands and a firearm shown for clarity, and with portions thereof shown in section or omitted for brevity.
Figure 2:
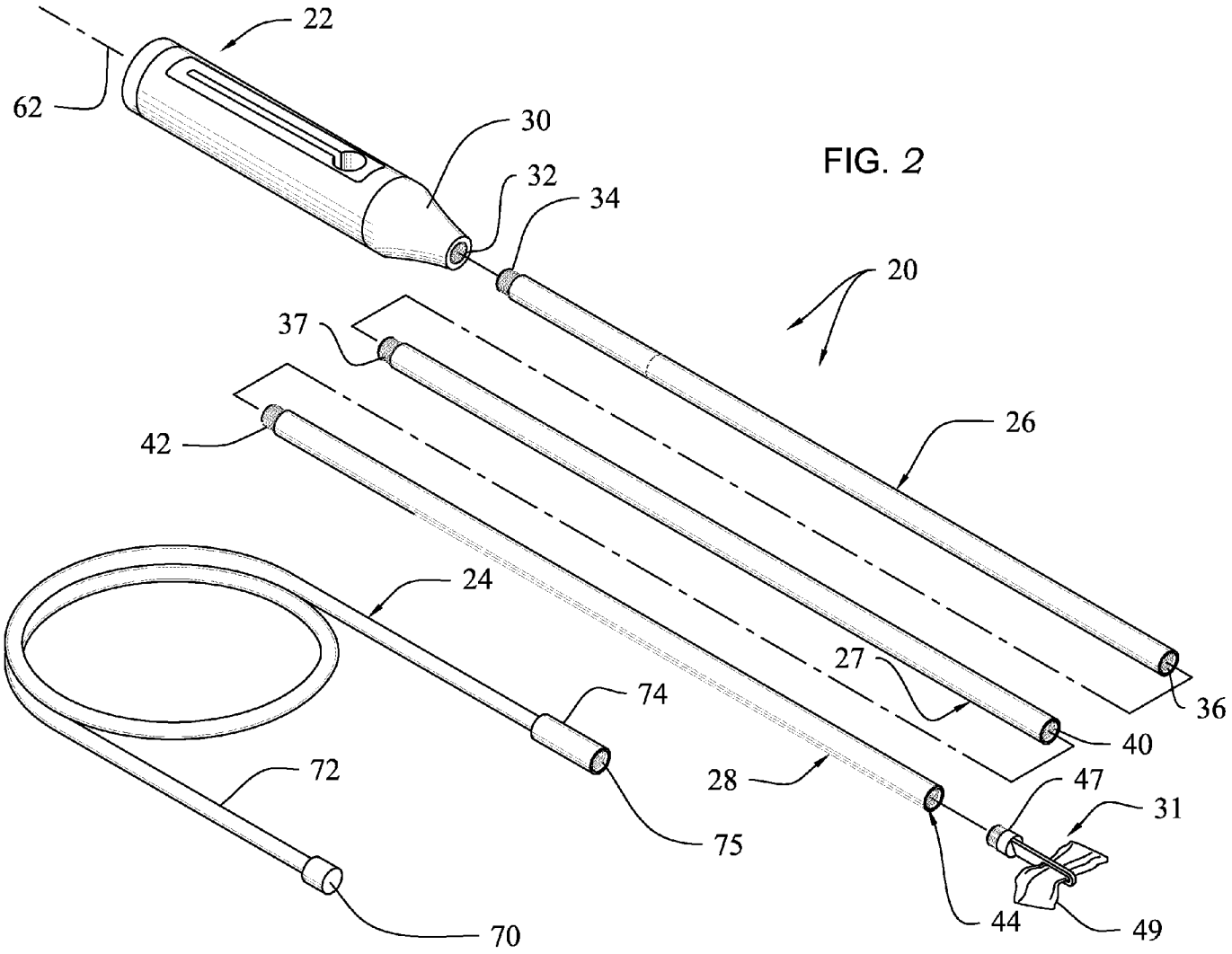
FIG. 2 is an enlarged, exploded isometric view of the major portions of my firearm cleaning kit.

With initial reference directed now to FIGS. 1-3 of the appended drawings, one embodiment of my new gun cleaning kits constructed in accordance with the best mode of the invention has been generally designated by the reference numeral 20. This embodiment, and all other embodiments comprise an elongated, generally cylindrical handle that can be used to pull cleaning implements through the barrel 23 of a firearm, so that the cleaning elements travel the entire length of the barrel and exit through the firearm muzzle 25. All cleaning kits and/or kit handles described herein can be used with long guns and a variety of pistols or weapons with shorter barrels. All kits can push or pull conventional elongated, rigid cleaning rods as well.

Kit 20, for example, has a handle 22 that controls a flexible pull cable 24 connected to conventional cleaning elements such as jags, patches, or brushes (not seen) that are inserted within a firearm barrel 23 through the breach and thereafter drawn through the barrel by the handle pulling the cable 24. Alternatively, the handle 22 may be mechanically interconnected with one or more traditional, tools, such as solid brass rods 26-28 (FIG. 2), for moving selected cleaning elements through the firearm barrel 23 (FIG. 1). In the "pulling mode" illustrated in FIG. 1, for example, the handle 22 has been grasped by the hand 21 of a user to pull a cleaning implement, such as tool 31 (FIG. 3) within the firearm barrel 23, eventually exiting muzzle 25. As used herein the term "pulling movement" refers to handle displacements indicated generally by arrow 29 (FIG. 1), which are generally perpendicular to the longitudinal axis of the handle. At this time the users opposite hand 21B may simultaneously grasp the barrel 23 to brace the firearm.

Suitable cleaning implements are well known in the art, and they include wire brushes, various fixtures, jags, patches, cloth segments, patch holders, and the like, all of which are typically ram driven or pulled by various rods engaged with some form of handle. Various cleaning implements and rods are disclosed in prior U.S. Pat. No. 7,020,994, issued Apr. 4, 2006, and entitled "Gun Cleaning Kit," which is owned by the same assignee as in this case, and which is hereby incorporated by reference for purposes of disclosure.

As seen in FIG. 2, the preferred handle 22 has a rigid, tapered front cap 30 that terminates in a threaded, front socket 32 for threadable attachment to any of the conventional brass rods 26-28. The individual rods 26-28 can be axially, threadably coupled together to form a cleaning rod of a desired length. Rod 26, for example, has a threaded end 34 that can engage handle socket 32. The opposite end of rod 26 has a threaded socket 36 similar to socket 32, which can engage companion rods 27 or 28. Rod 27, for example, has a threaded end 37 that can engage sockets 32 or 36. Rod 27 has a threaded socket 40 at its opposite end that can be threadably engaged by rod 28 by interconnecting threaded end 42. Rod 28 likewise terminates in a threaded socket 44 that can receive a cleaning tool, such as the generic tool 31 (FIG. 2). As used herein, the term "cleaning tool" refers to jags, patches, wire brushes, metallic brushes, fixtures, cloth segments, patch holders or the like, of the type used in the art for firearm cleaning. Threaded sockets 32, 36, 40 and 44 are preferably identical, but they may be sized as desired for different rods and different applications, such as varying gun calibers and barrel diameters.

The generic cleaning tool 31 (FIGS. 2, 3) comprises a threaded, draw fixture 47 that can threadably engage the handle socket 32 or any of the rod sockets 36, 40 or 44 discussed earlier. As illustrated, fixture 47 controls a conventional cleaning patch 49. The use of plural rods gives the user a wide choice in effective cleaning lengths, adapting the cleaning kit 20 for use with short barrel hand guns, with traditional long guns including rifles and shotguns, and everything in between. Flexible pull cable 24, seen in FIGS. 1 and 2, can substitute for rigid cleaning rods as explained below.

Figure 7:
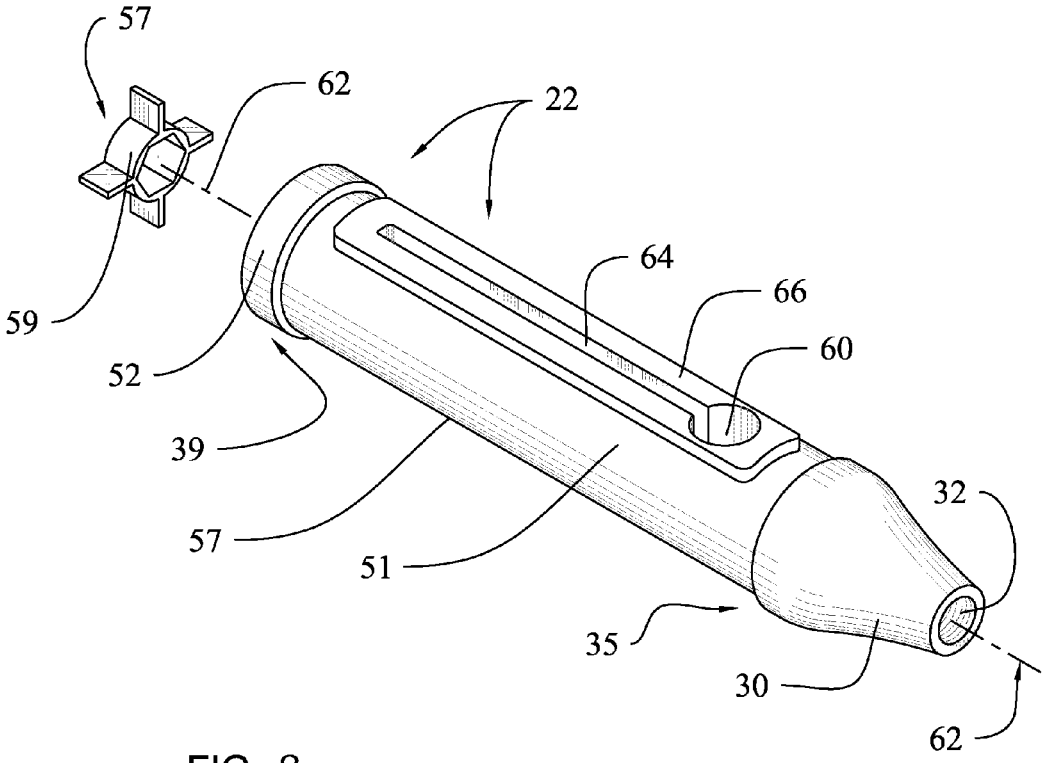
FIG. 7 is a partially exploded, frontal isometric view of the preferred handle with the outer shell removed.
Figure 8:
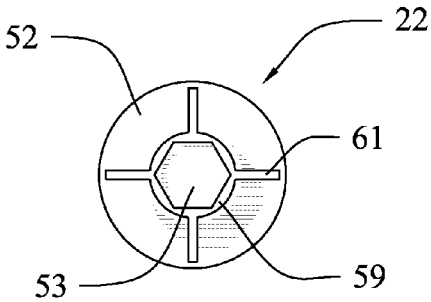
FIG. 8 is a rear plan view of the preferred handle.

With primary reference now directed to FIGS. 3-9, the preferred handle 22 comprises an elongated, generally cylindrical body 50, that can be machined or molded, preferably from plastic. Body 50 preferably comprises an inner, rigid plastic core 51 (FIG. 7) that is covered by a flexible, preferably rubber or fabric outer shell 55 (i.e., FIGS. 5, 6) that provides the user with a frictional grip. The body 50 has a tapered and preferably threaded cap 30 at its front 35 (FIG. 7). The cap 30 may be threadably coupled to body 50, or press fitted, or it may be machined or molded with the body, forming an integral structure.

Figure 9:
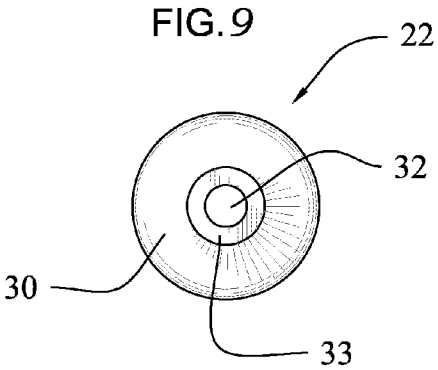
FIG. 9 is a front plan view of the preferred handle.

The threaded socket 32 defined in the front of cap 30 is coaxially surrounded by front annular surface 33 (FIG. 9). Socket 32 can threadably mate with cleaning tools or rods, such as those previously described. When one or more tools or rods 26-28 are threadably secured to the handle within socket 32 (i.e., FIGS. 7, 9) they may be pulled or pushed through a gun barrel for cleaning in a direction coincident with or generally parallel to the longitudinal axis 62 (FIGS. 4, 7).

Preferably there is a threaded accessory end plate 52 threadably coupled or press fitted to the rear 39 (FIG. 6) of the body 50 that comprises a rigid polygonal, fitting 57 (FIGS. 6, 7) that enables interconnection with various male, polygonal fittings or tools (i.e., preferably hex) that are known in the art. End plate 52 comprises a central, female orifice 53 (FIGS. 7, 8) in which fitting 57 is received and anchored. The preferably metal fitting 57 has a central, polygonal socket 59 that receives a variety of similarly shaped drive tools known in the art. Drive socket 59 is preferably hex, but may be configured in alternative configurations such as Torx® etc. Socket 59 is preferably integral with four, radially spaced apart, torsion wings 61 (FIG. 8) that reinforce the fitting 57 and anchor it within orifice 53 against rotation relative to the handle to prevent slip. Various conventional "snap in" nut drivers, screw drivers, tools, etc. snap fit to socket 59. Thus end plate 52 cooperates with cap 30 to enable the handle 22 to interconnect with a variety of miscellaneous tools and fittings.

Handle 22 may be manually twisted (i.e., by rotating it about its longitudinal axis 62) to operate nut drivers or the like projecting from handle rear 89. Concurrently, tools or rods threadably coupled to socket 59 can be pushed or pulled in a direction coplanar with or generally parallel to the longitudinal axis 62.

Importantly, however, tools or various devices may also be connected laterally to the handle 22 so that it may be grasped as in FIG. 1 and used for pulling. Stated another way, the handle 22 is adapted to pull various tools when it is displaced laterally, in a direction perpendicular to axis 62. To this effect, body 50 is provided with a through bore 60 (FIGS. 3, 5, 7) that is perpendicular to the longitudinal axis 62 (FIG. 7) of the handle 22. Bore 60 is intersected by an elongated follower slot 64 that is coextensive with the longitudinal axis of the handle 22 for at least a portion of the handle length. The diameter of bore 60 is preferably at least twice the width of the narrower follower slot 64, and most preferably three times the width of slot 64. Preferably, slot 64 and bore 60 both penetrate the entire diameter of the body 50 and solid core 51. Optionally there is a decorative, peripheral escutcheon plate 66 (FIG. 5) of substantially rectangular dimensions surrounding the bore 60 and slot 64.

The previously referenced, flexible pull cable 24 (FIGS. 2, 3) penetrates bore 60 and is retained by slot 64. Cable 24 includes a terminal anchor 70 that is fastened to the cable body 72. The opposite end of the cable body terminates in a generally tubular, female threaded fitting 74 (FIGS. 2, 3) having a threaded socket 75 that is similar to rod sockets 44, 40, 36 (FIG. 2), for example, that were previously described. Socket 75 may thus be coupled to a cleaning element or tool 31 (FIGS. 2, 3) or to a rod 26, 27 or 28 or other cleaning tool or item to be pulled and drawn through a firearm barrel 23 (FIG. 1) for cleaning.

For cable 24 to engage handle 22, the cable anchor 70 (FIG. 2) first penetrates the through bore 60. Once the cable 24 is pulled through the handle, the cable 24 is slidably displaced through and along the follower slot 64 to position the anchor 70 above the narrower follower slot 64, spaced apart from bore 60. Since the diameter of the anchor 70 exceeds the width of follower slot 64, the anchor 70 will be externally captivated by the handle to enable pulling of cable 24 and cleaning tool 31 or the like coupled to cable 24 as indicated by arrow 29 (FIG. 1). The dimensions of anchor 70 are not critical, as long as it exceeds the width of slot 64 and is sized to penetrate bore 60. While the anchor 70 is preferably cylindrical, it could be cubical or other shapes. All that is required is that the anchor 70 smoothly fit through bore 60, and that its dimensions exceed the width of follower slot 64.

FIGS. 10-13 illustrate a first alternative handle embodiment. Handle 82 comprises an elongated, hollow body 84 that is lighter than handle 22 previously described. The tubular, preferably metal body 84 threadably supports a tapered cap 86 at its front 87. An optional knurled region 85 (FIG. 11) aids in gripping. Cap 86 preferably has a front, threaded socket 88 (FIG. 13) for interconnection with various rods and tools as described earlier. An accessory end plate 90 is threadably coupled or press fitted to the rear end 89 of the body 84 to provide interconnection with various hex-fittings as before. Plate 90 comprises a central hub 91 defining a hex orifice 92 (FIG. 12) to which a variety of tools known in the art may be attached.

Figure 10:
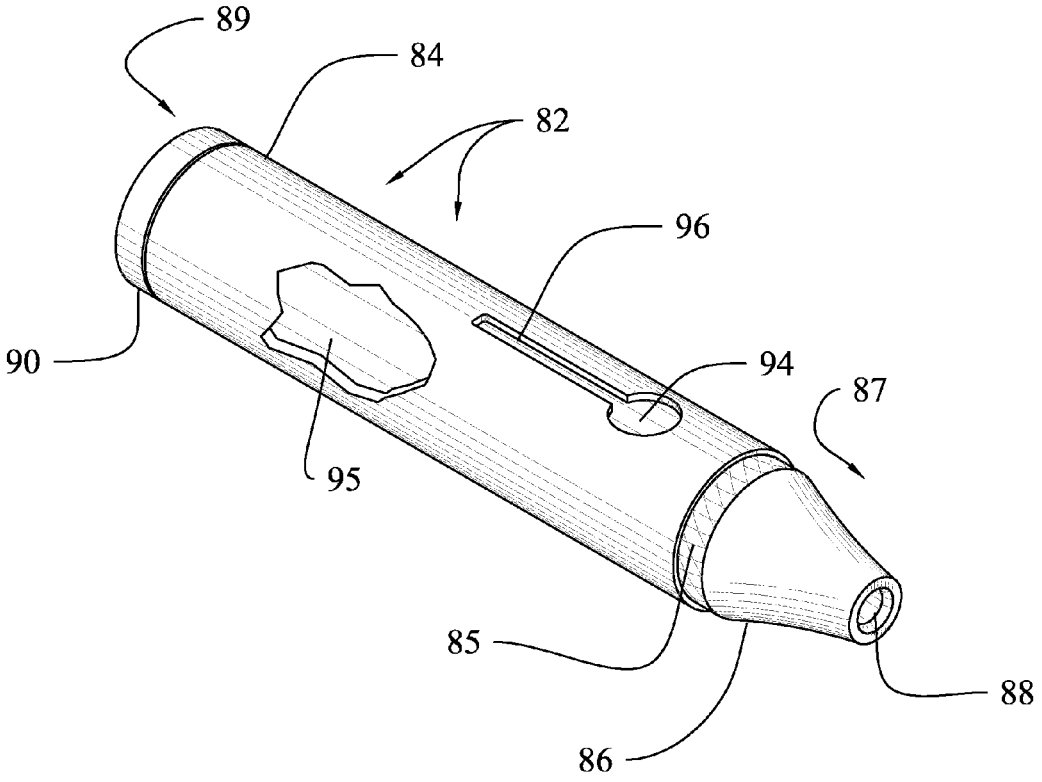
FIG. 10 is an isometric view of a first alternative handle embodiment, for use with the gun cleaning kits of the invention, with portions thereof broken away for clarity.

Body 84 (FIGS. 10-13) is hollow. Note the exposed, hollow tubular interior 95 (FIG. 10). Body 84 has at least one bore 94 penetrating its surface that intersects an elongated follower slot 96. Bore 94 and slot 96 are similar to bore 60 and follower slot 64 described earlier. Both enable mechanical access to the hollow interior of the body 84.

When cable 24 (FIG. 1) is connected, the cable anchor 70 is slidably captivated interiorly of the handle 82. In use, the anchor 70 is first inserted into the body interior 95 through the bore 94. Afterwards, by sliding interiorly along the inner portions of the follower slot 96, the anchor 70 is captivated inside the handle. Cleaning structures interconnected with the cable 24 can be then pulled by grasping the handle 82 and pulling it substantially as illustrated in FIGS. 1 and 3.

Figure 14:
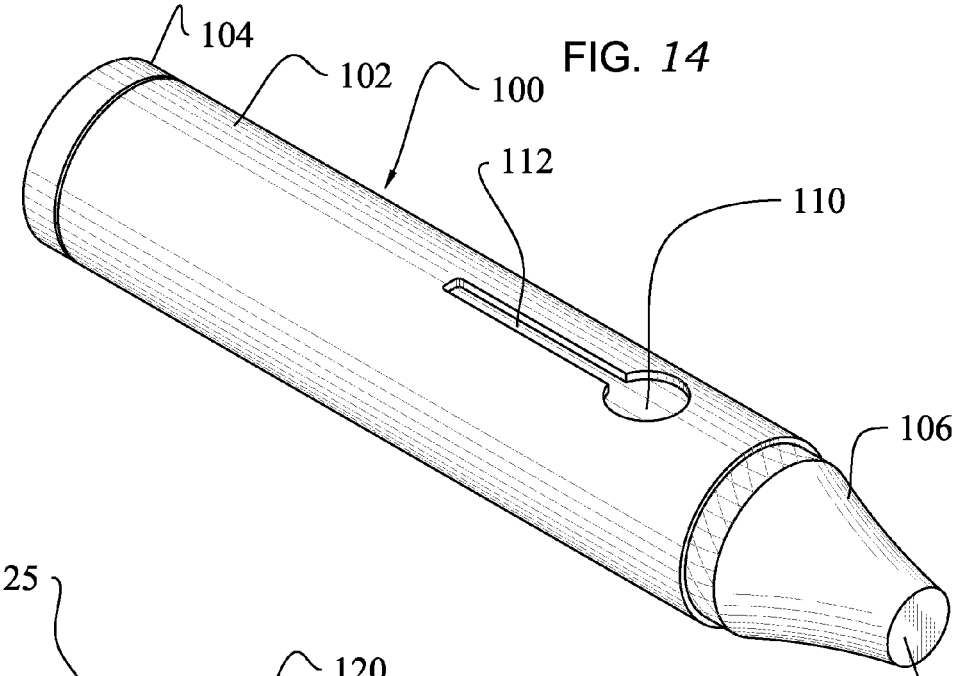
FIG. 14 is an isometric view of a second alternative handle embodiment for use with the gun cleaning kits of the invention.

The second alternative handle embodiment is seen in FIG. 14. Here the tubular handle 100 again has a hollow, tubular body 102. An end plate 104 may be affixed to the handle rear. However, front tapered cap 106 terminates in a solid circular end 108 (FIG. 14). A bore 110 and a companion follower slot 112 are defined in only one side of the body, to captivate cable anchor 70 interiorly as before.

Figure 15:
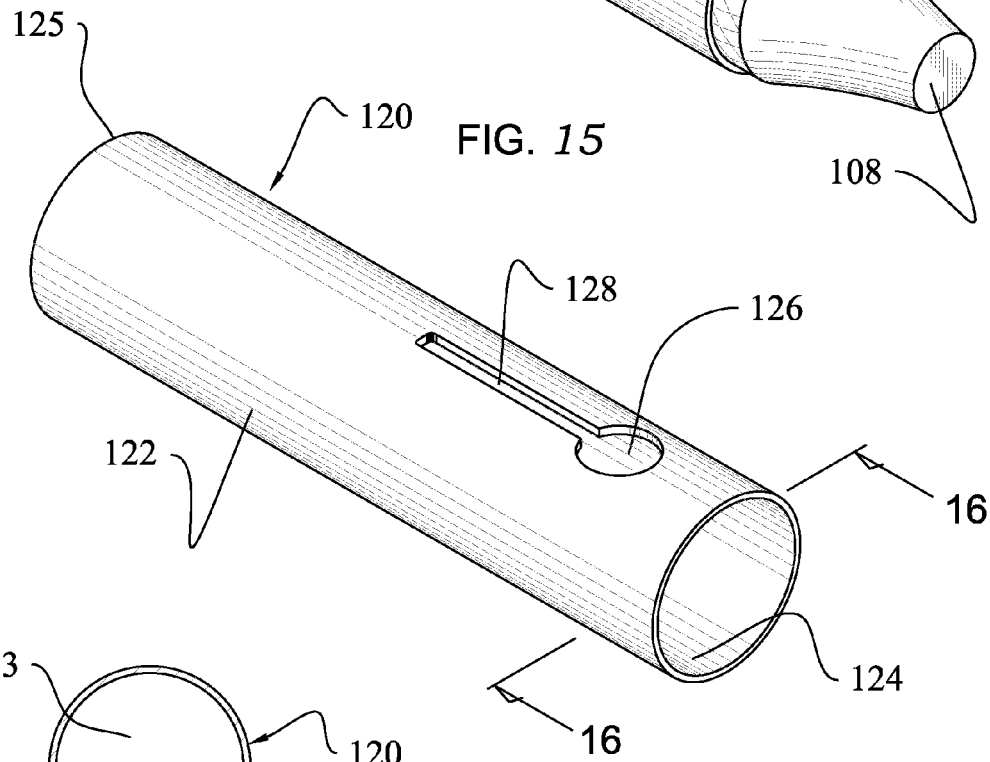
FIG. 15 is an isometric view of a third alternative handle embodiment, which has a hollow interior and at least one unblocked or open end.
Figure 16:
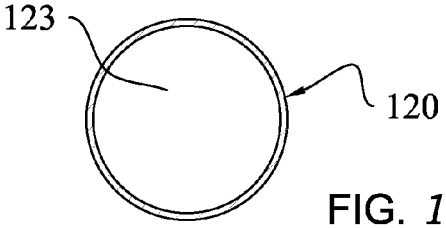
FIG. 16 is a sectional view of the third alternative handle embodiment taken generally along line 16-16 in FIG. 15.
Figure 17:
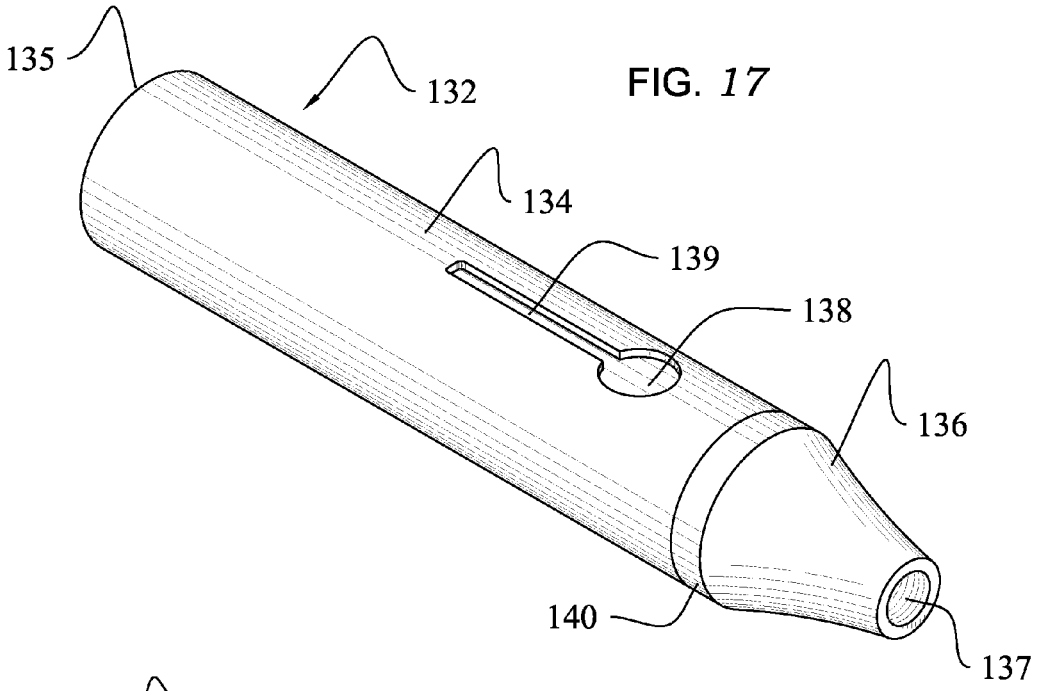
FIG. 17 is an isometric view of a fourth alternative handle embodiment for use with the gun cleaning kits of the invention.
Figure 18:
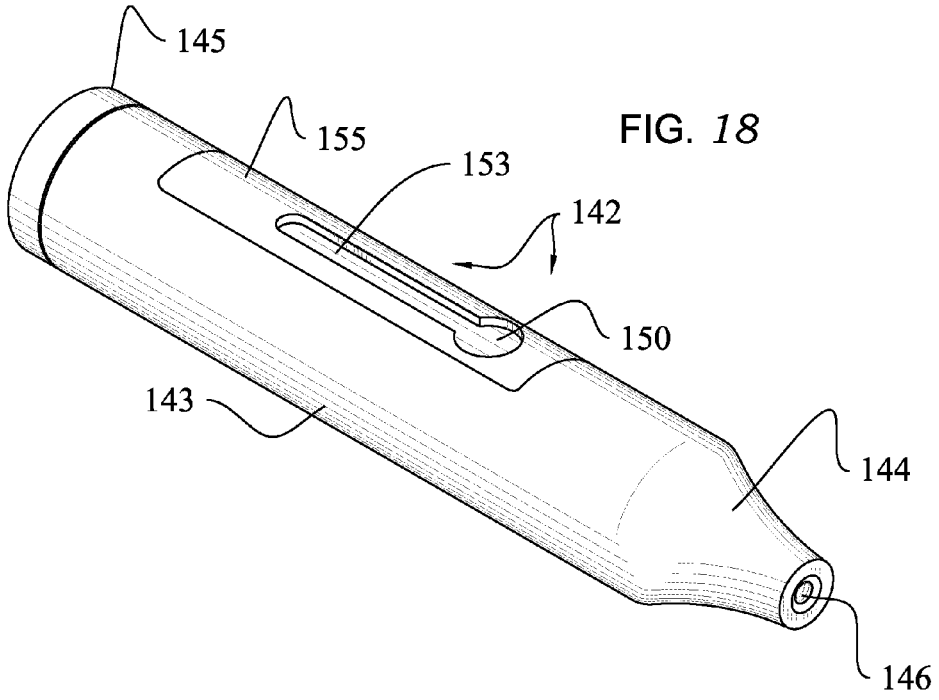
FIG. 18 is an isometric view of a fifth alternative handle embodiment for use with the gun cleaning kits of the invention.
Figure 22:
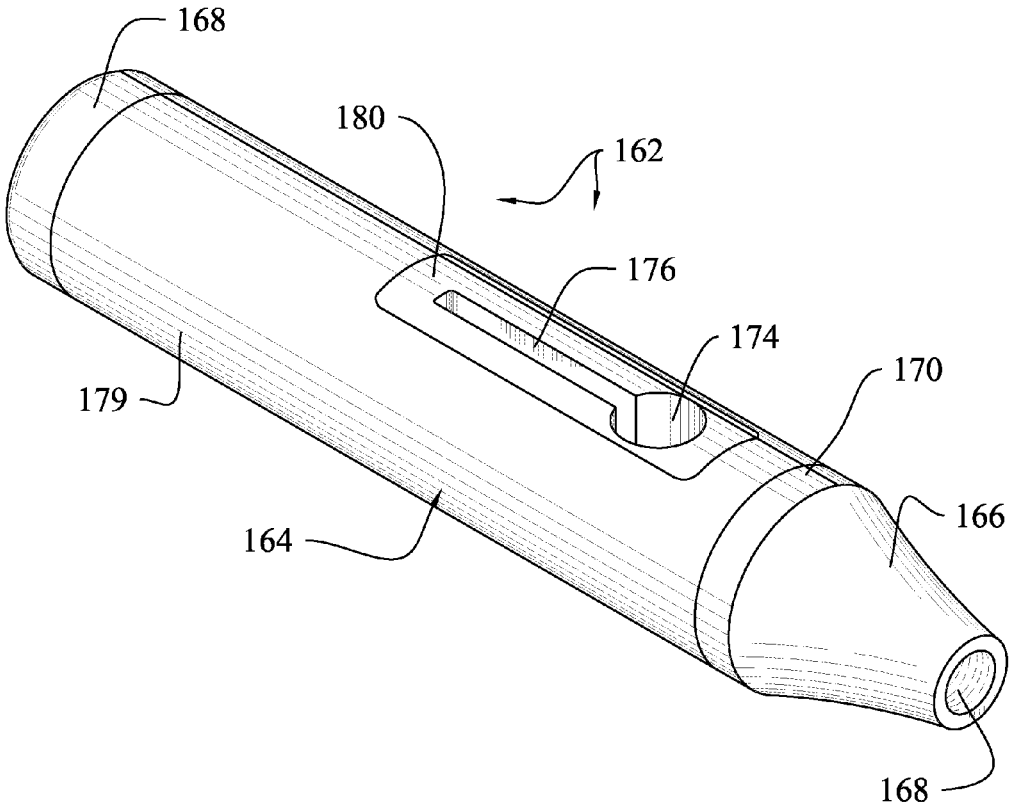
FIG. 22 is an isometric view of a sixth alternative handle embodiment.
Figure 23:
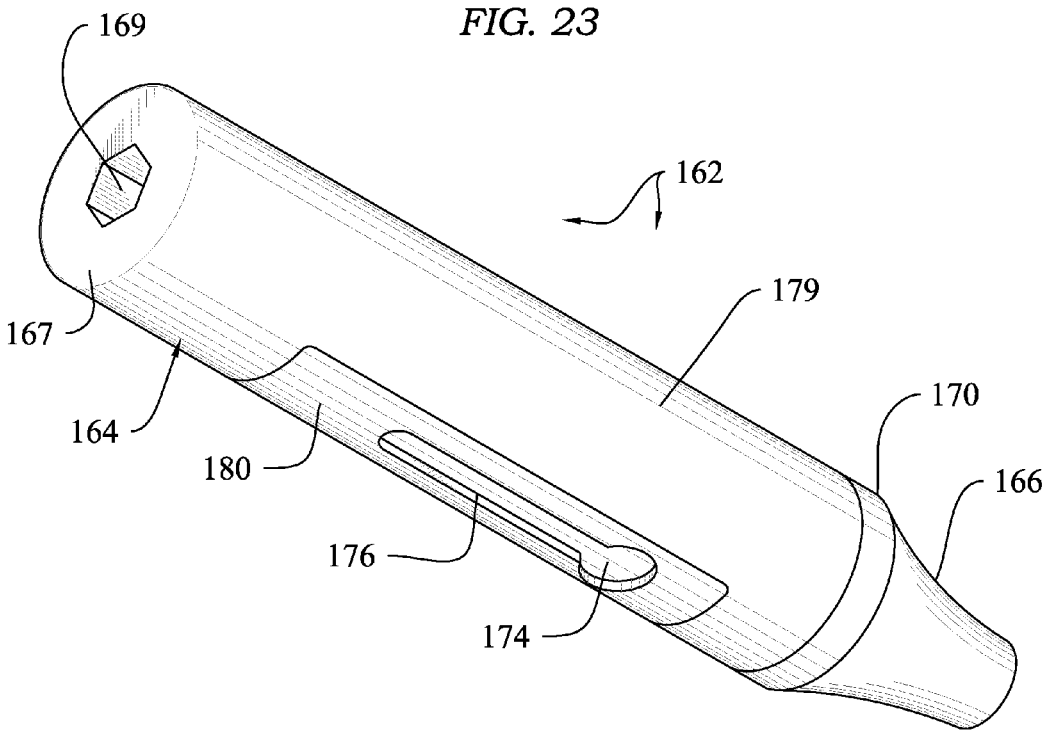
FIG. 23 is a bottom isometric view of the handle embodiment of FIG. 22.
Figure 24:
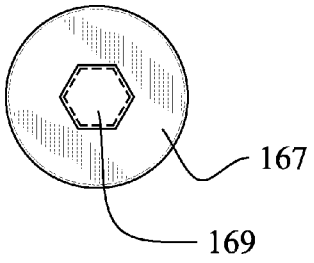
FIG. 24 is a rear plan view of the handle of FIGS. 22 and 23.
Figure 25:
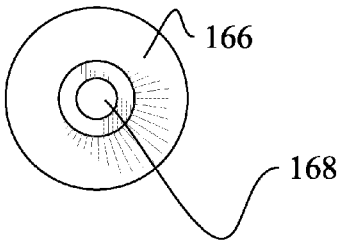
FIG. 25 is a front plan view of the handle of FIGS. 22-24.
Figure 26:
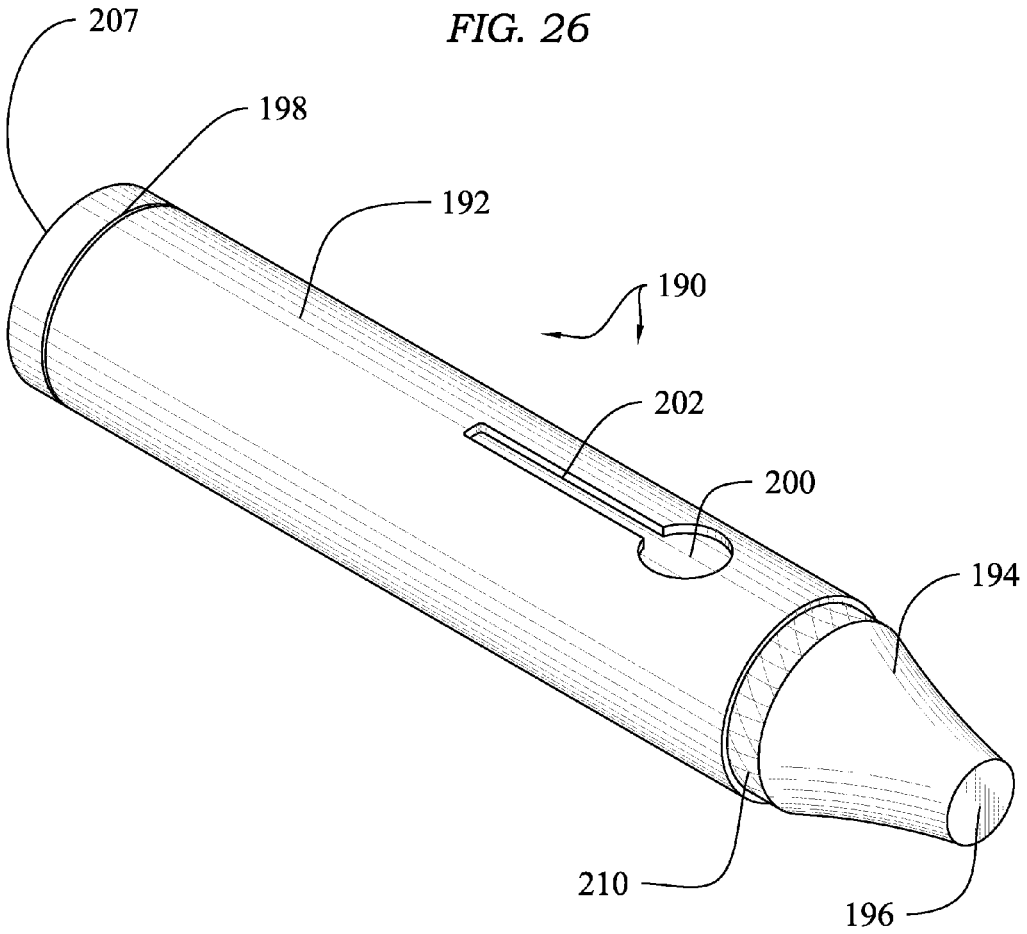
FIG. 26 is an isometric view of a seventh alternative handle embodiment.

The third alternative handle embodiment of FIGS. 15 and 17 comprises a tubular handle 120 having a hollow, metal body 122 and a hollow interior 123. The front end 124 and rear end 125 are preferably open, as illustrated in FIG. 16. A bore 126 and a companion follower slot 128 are defined in only one side of the body. Thus cable anchor 70 (FIG. 2) is interiorly captivated as with the second handle embodiment 100.

Handle 132 (FIG. 17) comprises a fourth alternative handle embodiment. Handle 132 comprises an elongated, hollow body 134 that may have an open rear end 135. The tubular, preferably metal body 134 threadably supports a threaded, tapered cap 136 at its front which has a threaded socket 137 for connecting with various cleaning rods or tools (FIG. 16) as before. Border region 140 (FIG. 17) between the front cap 130 and the body 134 may or may not be knurled. In use, cable anchor 70 (FIG. 2) is interiorly captivated within the hollow body 134 after penetrating bore 138 and sliding against follower slot 139 within the handle body.

The fifth alternative handle embodiment 142 of FIGS. 18-21 has a hollow body 143 with an integral, tapered front nose portion 144. A threaded attachment orifice 146 is disposed at the front of nose 144. A rear end plate 145, similar to end plates 90 and 104 may be provided. The bore 150 intersects a similar follower slot 153 for interiorly captivating the cable anchor 70 discussed above. Escutcheon plate 155 (FIGS. 18, 19) is similar to escutcheon plate 66 (i.e., FIGS. 3, 5) discussed earlier. The rear end plate 145 of handle 142 has a recessed hex socket 157 coaxial with a chamfered region 158 that is centered within end plate annular rear surface 159.

The fifth alternative handle embodiment 142 of FIGS. 18-21 has a hollow body 143 with an integral, tapered front nose portion 144. A threaded attachment orifice 146 is disposed at the front of nose 144. A rear end plate 145, similar to end plates 90 and 104 may be provided. The bore 150 intersects a similar follower slot 153 for interiorly captivating the cable anchor 70 discussed above. Escutcheon plate 155 (FIGS. 18, 19) is similar to escutcheon plate 66 (i.e., FIGS. 3, 5) discussed earlier. The rear end plate 145 of handle 142 has a recessed hex socket 157 coaxial with a chamfered region 158 that is centered within end plate annular rear surface 159.

Referencing FIGS. 22-25, a sixth alternative handle embodiment 162 has a solid body 164 with a tapered, front cap 166. A threaded attachment orifice 168 (FIG. 25) is disposed at the front of cap 166. A solid rear end 167 may be provided with a hex drive socket 169 (FIG. 24) as in prior embodiments. Border region 170 (i.e., FIGS. 22, 23) between cap 166 and body 164 may or may not be knurled. The bore 174 intersects an elongated follower slot 176 for exteriorly captivating the cable anchor 70 discussed above. Preferably the body comprises a rigid, plastic inner core that is covered by a rubber or fabric outer shell 179 that is similar to shell 55 (i.e., FIGS. 5, 6) discussed earlier. An exposed region 180 of the core, which is surrounded by outer shell 179, resembles escutcheon plate 155 (FIGS. 18, 19) and escutcheon plate 66 (i.e., FIGS. 3, 5) discussed earlier. In the latter embodiment the bore 174 and the follower slot 176 both penetrate the entire core and body. Thus, in use, the pull cable 24 (FIG. 2) has its anchor 70 slidably captivated over the follower slot 176 externally of the handle body.

The seventh alternative handle embodiment 190 of FIGS. 26-29 has a hollow body 192 with an integral, tapered front nose portion 194. Instead of a threaded attachment orifice, a flat driving surface 196 is disposed at the front of nose portion 194. A rear end plate 198, similar to end plates 90 and 104, may be provided. The rear end plate 198 may have a polygonal or hex socket or it may comprise merely a flat driving surface 207 (FIG. 27). Border region 210 (FIG. 26) between the front cap and the body may or may not be knurled. The bore 200 intersects a follower slot 202 for interiorly captivating the cable anchor 70 as discussed above.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A firearm cleaning kit comprising:

an elongated handle adapted to be grasped by a user, the handle comprising a longitudinal axis;

a cable adapted to be fed through a firearm barrel and connected at one end to a cleaning tool, the cable terminating at an opposite end in an anchor;

the handle comprising a bore through at least a portion of the handle through which the anchor is passed;

the handle comprising a follower slot intersecting said bore along and through which the cable may slides with the anchor captivated over said slot; and, whereby the handle is displaced in a pulling movement generally perpendicular to said longitudinal axis to pull said cable through the firearm such that said cleaning tool is drawn through the barrel towards the firearm muzzle.

2. The cleaning kit as defined in claim 1 wherein said kit comprises at least one cleaning rod adapted to be pushed or pulled by said handle.

3. The cleaning kit as defined in claim 2 wherein said handle comprises an end provided with a threaded socket for threadably mating with threaded cleaning tools or said cleaning rod.

4. The cleaning kit as defined in claim 3 wherein said threaded socket is defined in a tapered front cap attached to said handle.

5. The cleaning kit as defined in claim 1 wherein said handle comprises an end provided with a polygonal drive socket for mating with various tools.

6. The cleaning kit as defined in claim 1 wherein the handle comprises an inner, rigid plastic core that is covered by a flexible, outer shell.

7. The cleaning kit as defined in claim 1 wherein the handle comprises a rear end plate with a polygonal drive socket for operating drive tools.

8. The cleaning kit as defined in claim 7 wherein the drive socket is a part of a rigid fitting coupled to said end plate, the fitting comprising a plurality of radially spaced apart, torsion wings that reinforce the fitting and anchor it within the end plate to prevent slip.

9. The cleaning kit as defined in claim 1 wherein a diameter of the bore is at least twice a width of the follower slot.

10. The cleaning kit as defined in claim 1 wherein the cable terminates in a generally tubular, threaded socket adapted to be coupled to a cleaning tool, cleaning rod, or other item to be pulled and drawn through a firearm barrel for cleaning.

11. A firearm cleaning kit comprising:

a rigid, elongated, hollow handle adapted to be grasped by a user, the handle comprising a longitudinal axis;

a cable adapted to be fed through a firearm barrel and connected at one end to a cleaning tool, the cable terminating at an opposite end in an anchor;

the handle comprising a bore through at least a portion of the handle through which the anchor is passed, the bore having a diameter;

the handle comprising a follower slot intersecting said bore along and through which the cable slides with the anchor captivated against said slot within said handle, the slot having a width smaller than the bore diameter; and, whereby the handle is displaced in a pulling movement generally perpendicular to said longitudinal axis to pull said cable through the firearm such that said cleaning tool is drawn through the barrel towards the firearm muzzle.

12. The cleaning kit as defined in claim 11 wherein said kit comprises at least one cleaning rod adapted to be pushed or pulled by said handle.

13. The cleaning kit as defined in claim 12 wherein said handle comprises a tapered front cap provided with a threaded socket for threadably mating with threaded cleaning tools or said cleaning rod.

14. The cleaning kit as defined in claim 12 wherein said handle comprises a rear end plate provided with a polygonal drive socket for mating with and driving various tools.

15. The cleaning kit as defined in claim 14 wherein the drive socket is a part of a rigid fitting coupled to said end plate, the fitting comprising a plurality of radially spaced apart, torsion wings that reinforce the fitting and anchor it within the end plate to prevent slip.

16. The cleaning kit as defined in claim 11 wherein a diameter of the bore is at least twice a width of the follower slot.

17. The cleaning kit as defined in claim 11 wherein the cable terminates in a generally tubular, threaded socket adapted to be coupled to a cleaning tool, cleaning rod, or other item to be pulled and drawn through a firearm barrel for cleaning.

18. The cleaning kit as defined in claim 11 wherein the handle comprises an open front end and an open rear end.

19. A firearm cleaning kit comprising:

an elongated, solid handle adapted to be grasped by a user, the handle comprising a substantially cylindrical body, a front, a rear, a length, and a longitudinal axis extending through said body between said front and rear;

a flexible cable adapted to be connected at one end to a cleaning tool, the cable terminating at an opposite end in an anchor;

the handle comprising a bore extending through the handle through which the anchor is passed, the bore perpendicular to the handle's longitudinal axis;

the handle comprising a follower slot intersecting said bore and extending through the handle along which the cable may slide such that the anchor is captivated over said slot, the follower slot being coextensive with the longitudinal axis of the handle for at least a portion of the handle length; and, whereby the handle is displaced in a pulling movement generally perpendicular to said longitudinal axis to pull said cable through the firearm such that said cleaning tool is drawn through the barrel towards the firearm muzzle.

20. The cleaning kit as defined in claim 19 wherein said kit comprises at least one cleaning rod adapted to be pushed or pulled by said handle.

21. The cleaning kit as defined in claim 19 wherein said handle comprises a tapered front cap provided with a threaded socket for threadably mating with threaded cleaning tools or said cleaning rod.

22. The cleaning kit as defined in claim 19 wherein said handle comprises a rear end plate provided with a polygonal drive socket for mating with and driving various tools.

23. The cleaning kit as defined in claim 22 wherein the drive socket is a part of a rigid fitting coupled to said end plate, the fitting comprising a plurality of radially spaced apart, torsion wings that reinforce the fitting and anchor it within the end plate to prevent slip.

24. The cleaning kit as defined in claim 19 wherein a diameter of the bore is at least twice a width of the follower slot.

25. The cleaning kit as defined in claim 19 wherein the cable terminates in a generally tubular, threaded socket adapted to be coupled to a cleaning tool, cleaning rod, or other item to be pulled and drawn through a firearm barrel for cleaning.

26. The cleaning kit as defined in claim 19 wherein the handle comprises an open front end and an open rear end.

27. A handle for cleaning or maintaining firearms, the handle comprising:

a longitudinal axis; a bore defined through at least a portion of the handle;

a follower slot defined through at least a portion of the handle, said slot intersecting said bore; whereby a pulling cable adapted to be connected at one end to a cleaning tool and comprising an anchor at an opposite end coupled to said handle by passing said anchor through said bore and then moving the cable within said slot such that the anchor is captivated over said slot; and, whereby the handle is displaced in a pulling movement generally perpendicular to said longitudinal axis to pull said cable through the firearm such that said cleaning tool attached to said cable is drawn through the barrel towards the firearm muzzle.

28. The handle as defined in claim 27 wherein said handle comprises an end provided with a threaded socket for threadably mating with threaded cleaning tools or cleaning rods.

29. The handle as defined in claim 28 wherein said threaded socket is defined in a tapered front cap attached to said handle.

30. The handle as defined in claim 27 further comprising an end provided with a polygonal drive socket for mating with various tools.

31. The handle as defined in claim 27 wherein the handle comprises an inner, rigid plastic core that is covered by a flexible, outer shell.

32. The handle as defined in claim 27 further comprising a rear end plate with a polygonal drive socket for operating similarly shaped drive tools.

33. The handle as defined in claim 28 wherein the drive socket is a part of a rigid fitting coupled to said end plate, the fitting comprising a plurality of radially spaced apart, torsion wings that reinforce the fitting and anchor it within the end plate to prevent slip.

34. The handle as defined in claim 27 wherein a diameter of the bore is at least twice a width of the follower slot.

35. The handle as defined in claim 33 wherein the handle comprises an open front end and an open rear end.

36. A firearm cleaning handle comprising:

a solid body having a longitudinal axis;

a front and a rear and a length;

a longitudinal axis extending through said body between said front and rear;

a bore defined through at least a portion of the body;

a follower slot defined through at least a portion of the body, said slot intersecting said bore and being coextensive with the longitudinal axis of the handle for at least a portion of the handle length;

whereby a pulling cable adapted to be connected at one end to a cleaning tool and comprising an anchor at an opposite end coupled to said handle by passing said anchor through said bore and then moving the cable within said slot such that the anchor is captivated over said slot; and, whereby the handle is displaced in a pulling movement generally perpendicular to said longitudinal axis to pull said cable through the firearm such that said cleaning tool is drawn through the barrel towards the firearm muzzle.

37. The handle as defined in claim 36 further comprising a tapered front cap provided with a threaded socket for threadably mating with threaded cleaning tools, or cleaning rods.

38. The handle as defined in claim 36 wherein said handle comprises a rear end plate provided with a polygonal drive socket for mating with and driving various tools.

39. The handle as defined in claim 38 wherein the drive socket is a part of a rigid fitting coupled to said end plate, the fitting comprising a plurality of radially spaced apart, torsion wings that reinforce the fitting and anchor it within the end plate to prevent slip.

40. The handle as defined in claim 38 wherein a diameter of the bore is at least twice a width of the follower slot.

* * * * *